United States Patent [19]

Shepherd

[11] 4,208,755

[45] Jun. 24, 1980

[54] TRACK WIPER FOR SLIDING SHOWER DOOR ASSEMBLY

[76] Inventor: L. Clay Shepherd, P.O. Box 85, Soulsbyville, Calif. 95372

[21] Appl. No.: 9,147

[22] Filed: Feb. 5, 1979

[51] Int. Cl.[2] ..... A46B 3/00

[52] U.S. Cl. ..... 15/160; 49/404; 15/210 R

[58] Field of Search ..... 15/160, 246, 210 R; 49/404, 411, 475, 495, 431; 308/3.5; 16/87 R; 277/53, 54

[56] References Cited

U.S. PATENT DOCUMENTS

| | | | |
|---|---|---|---|
| 1,098,894 | 6/1914 | Dobler | 49/431 |
| 1,938,786 | 12/1933 | Vancil | 308/3.5 |
| 2,568,477 | 9/1951 | Westlund | 15/160 |
| 2,889,585 | 6/1959 | Le Bon | 49/495 |
| 3,493,032 | 2/1970 | Brown | 16/87 R |
| 3,515,444 | 6/1970 | Grabner | 308/3.5 |
| 3,600,857 | 8/1971 | La Barge | 49/404 |
| 3,961,392 | 6/1976 | Young | 15/210 R |
| 4,127,968 | 12/1978 | Trulaske | 49/404 |

*Primary Examiner*—Billy J. Wilhite
*Attorney, Agent, or Firm*—Thomas Schneck

[57] ABSTRACT

A wiper for attachment to the bottom edge of a sliding door or window, particularly a shower door, so that as the door is opened and closed the track along which it runs is wiped clear of standing fluid. The wiper preferably includes a base member which is attached to the door and a water dispersive pad attached to the base member in wiping contact with the track.

14 Claims, 9 Drawing Figures

TRACK WIPER FOR SLIDING SHOWER DOOR ASSEMBLY

BACKGROUND OF THE INVENTION a. Field of the Invention

This invention relates generally to brushes, wipers and other scrubbing devices, particularly when those devices are attached to movable closures, particularly sliding doors or windows.

b. Description of the Prior Art

Some showers are provided with sliding shower door assemblies which generally include a pair of doors each slidable along its own, individual track. When the shower is used, these tracks tend to fill with a soapy water solution which leaves an unattractive and unsanitary residue, the removal of which is a time consuming and unpleasant job. This invention contemplates the use of a scrubbing device attached to the shower door to automatically clean the track as the door is opened and closed.

The simple attachment of a brush to a door or window is not new. For example, J. V. Westlund discloses, in U.S. Pat. No. 2,568,477, a door check including a brush made up of a number of spaced clusters of bristles coupled to the bottom edge of a swinging door. The brush is in frictional contact with the floor, which slows or checks the swinging motion of the door. It will be noted that the brushes of Westlund's device are not well adapted to clean the floor beneath the door due to the substantial separation between individual clusters of bristles.

P. Dobler, in U.S. Pat. No. 1,098,894, discloses a device for automatically holding doors, windows, etc. at a particular position. In its simplest form, Dobler's device consists of a first brush attached along an edge of the door or window and a second brush attached to the door or window frame in frictional contact with the first brush, where the friction created is great enough to maintain the door or window at a particular position. Once again, Dobler's device uses brushes as a friction type device that performs no cleaning function.

While other friction type uses of brushes are disclosed in U.S. Pat. No. 3,493,032 of W. S. Brown, Jr., et al. and U.S. Pat. No. 3,600,857 of R. LaBarge, it does not appear that the prior art has contemplated the attachment of a brush or other scrubbing type device to a door or window so as to perform a cleaning operation during the normal opening and closing of the door or window.

SUMMARY OF THE INVENTION

An object of this invention is to provide a wiper for a sliding door or window assembly which has a dispersant effect upon water and other residue which collects in tracks of sliding doors and windows.

It is a further object of this invention to provide such a wiper that is inexpensive to produce, easy to install, and one which requires little or no maintenance.

Briefly, the invention comprises a fluid dispersive pad that is coupled to a sliding door or window so that it is in contact with an entire lateral width of the bottom of that door's or window's track. The pad is preferably formed by fastening a dense mass of bristles to a surface of a resilient, underlying substrate. An opposing surface of the substrate is preferably fastened to a base member which is attached to the bottom edge of the sliding door or window preferably either by a friction type bracket or by means of a suitable fastener. In one embodiment of this invention the base member extends beyond a vertical edge of the door or window and has a terminal section bent upwardly to create a wiping surface for the end and sidewalls of the track.

An advantage of this invention is that every time the sliding door or window is opened or closed its track is wiped to effect a dispersal of any water or residue that has collected therein. Furthermore, should the tracks be provided with drainage holes, the wipers would tend to expel the water and residue from the track through the holes.

Another advantage of this invention is that its uncomplicated design allows for its inexpensive, yet rugged and durable, construction.

Yet another advantage of this invention is that it is easily installed to virtually any sliding door or window, making it an extremely attractive retrofit item.

DETAILED DESCRIPTION OF A PREFERRED EMBODIMENT

Figure 1:
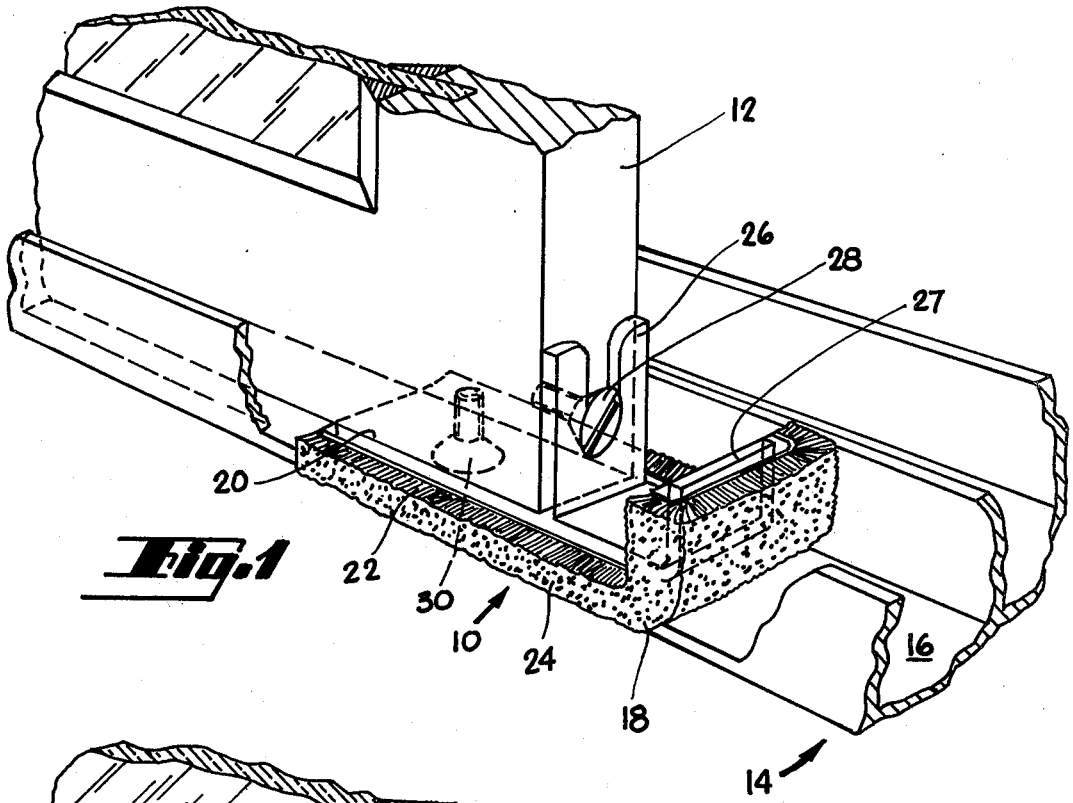
FIG. 1 is a partial perspective view of a wiper of this invention attached to a door of a sliding shower door assembly.

In FIG. 1 a wiper 10 is shown attached to a sliding shower door 12 which runs along a shower door track 14. The shower door is slidably supported from above so that it is separated by a small distance from the bottom 16 of the shower door track.

Wiper 10 includes a water dispersive pad 18 that is coupled to sliding door 12 by a base member 20. In this embodiment, pad 18 includes a resilient substrate 22 to which is attached a thick mass of short bristles 24. A pad suitable for use with the present invention is of the type made by the 3-M Corporation and which is commonly utilized in commercially available paint pads. The pad is sufficiently wide to fully contact the lateral width of bottom 16 of the track. Of course, other types of fluid dispersive pads, such as a thin sponge, natural or synthetic material or fabric could be used for the pad described above.

Base 20, in this embodiment, is an elongated, flat strip of material attached along the bottom edge of the shower door. Attached to and upwardly extending from base 20 is a bifurcated flange 26 which can be attached to the end of shower door 12 by means of a sheet metal screw or other fastener 28. The base member may be supplementally attached to the sliding shower door by means of a second fastener 30, although such a precaution is not usually necessary. A leading edge 27 of base member 20 extends beyond a vertical edge of shower door 12 and a terminal section of that portion is bent upwardly so as to be substantially parallel to flange 26. Pad 18 follows the contour of the bent terminal end section of the base member so as to clean the end and corners of track 14. As seen, the pad is actually formed a bit wider than the width of the track so that some of the bristles 24 extend to the sidewalls.

Figure 2:
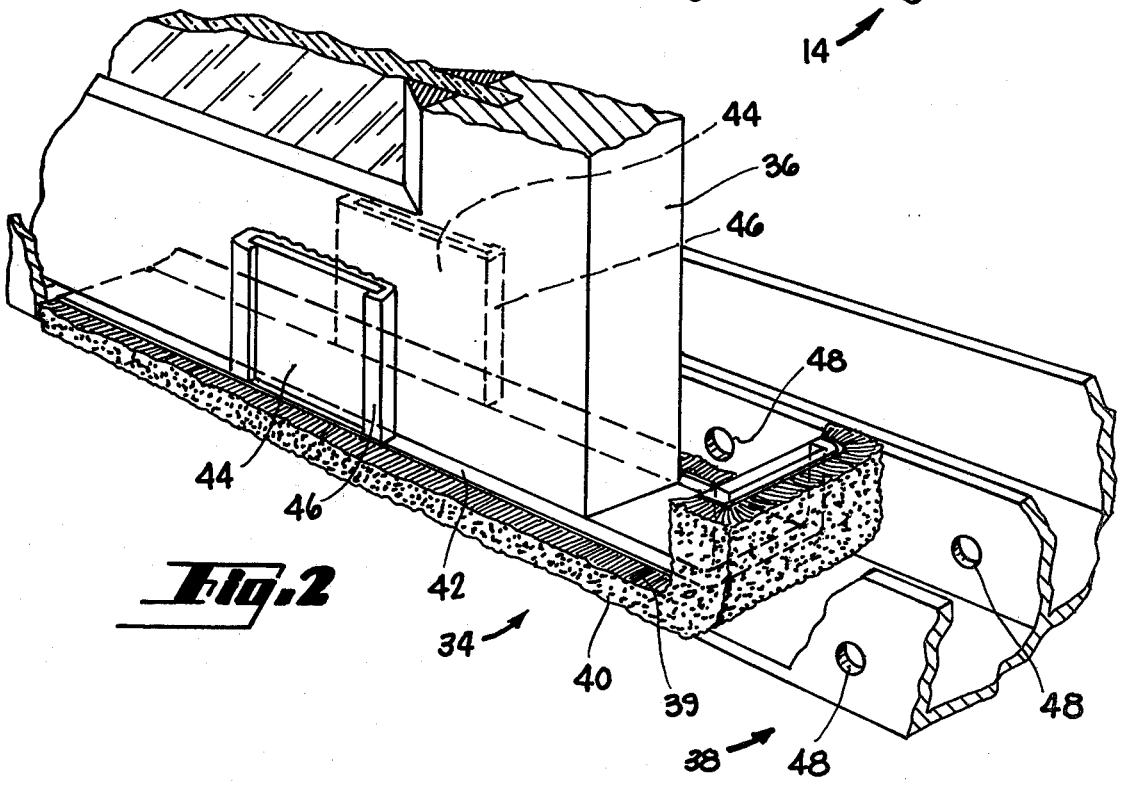
FIG. 2 is a partial perspective view of an alternate embodiment of the wiper of this invention.

In FIG. 2, an alternate embodiment for a wiper 34 is shown to be attached to a shower door 36 which runs along a shower door track 38. This embodiment, as in the case of the previous one, includes a pad 40 which is attached, preferably by gluing, to a backing member, such as a thin rubber layer 39, which is connected to an elongated base 42. In this embodiment, a bracket member formed by a spaced apart pair of upright arm members 44 is attached to the base. This bracket slidably engages opposing sides of the shower door proximate its bottom edge. To increase the frictional coupling between the bracket and sliding door 36, rubber sleeves 46 or the like can be placed over the surfaces of arm members 44 that face the shower door.

It can also be seen in this figure that a terminal section of base 24 is bent upwardly, as was the case of the previous embodiment. This is because the upwardly bent section is disposed against the edge of the door.

It will be also noted that the shower door track of FIG. 2 is provided with a number of drainage holes 48. When the tracks are provided with such holes the pad 40 has a tendency to expel any liquid or loose particulate matter from the track as the door to which it is attached is opened or closed.

Figure 3:
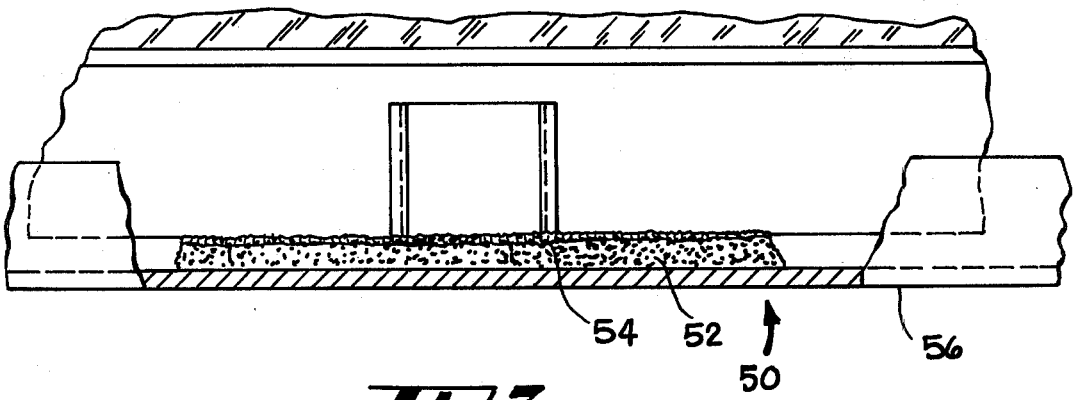
FIG. 3 is a partial side elevational view of yet another wiper in accordance with the present invention.

Referring now to FIG. 3, yet another alternate embodiment of a dispersive wiper 50 is shown. In this embodiment, the pad 52 and base member 54 extend along the entire length of the bottom edge 56 of the shower door. This is opposed to yet another embodiment of this invention which has one or more short wipers spaced along the length of bottom edge 56.

Figure 5:
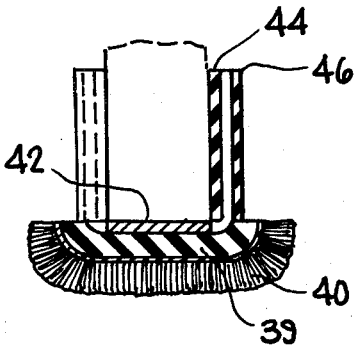
FIG. 5 is a cross sectional view taken along line 5—5 of FIG. 4.
Figure 4:
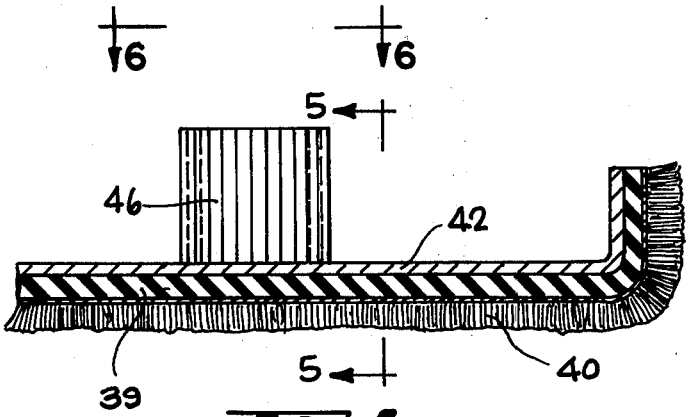
FIG. 4 is a cross sectional view of the wiper shown in FIG. 2.
Figure 6:
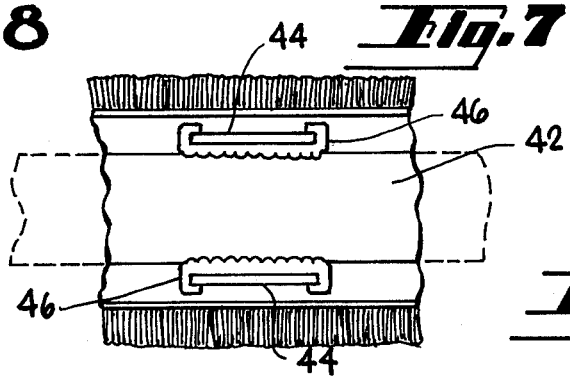
FIG. 6 is a view taken along line 6—6 of FIG. 4.

Referring to FIGS. 4, 5 and 6, the embodiment of the wiper illustrated in FIG. 2 may be more fully discussed. Again, the base 42 is preferably constructed of a strong, lightweight metal. Upright arm members 44 are shown to be covered with natural or synthetic rubber sleeves 46 which are preferably scalloped in order to increase the frictional surface area. The substrate and bristle construction of this alternate embodiment are similar to that of the first embodiment and function in substantially the same manner. The thin rubber substrate layer 39 provides resilient backing for attaching bristles or the wiping pad to metal. The substrate 39 is adhesively compatible with both the pad material and the base material.

Figure 8:
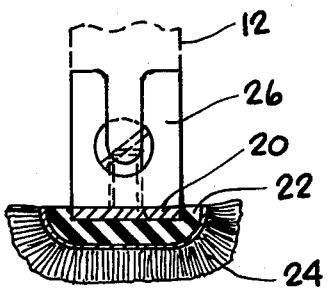
FIG. 8 is a partial end elevational view as seen along line 8—8 of FIG. 7.
Figure 7:
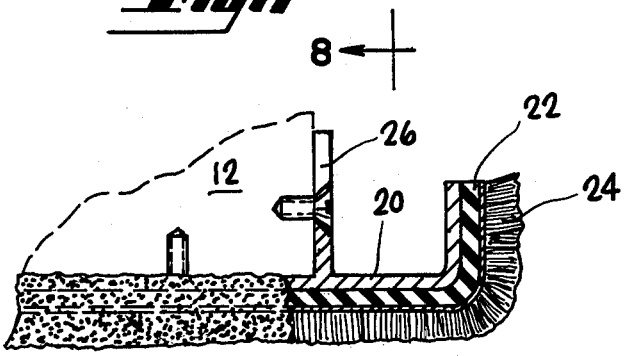
FIG. 7 is a partial side elevational view of the wiper shown in FIG. 1.

Referring now to FIGS. 7 and 8, the construction of the wiper of the first embodiment may be more fully described. The base member 20 is preferably constructed from a strong, rigid material such as aluminum, steel or plastic and can be cast, molded, cut, extruded or otherwise formed into its final configuration. Substrate 22 is preferably of the natural or synthetic rubber type and is usually directly glued onto the base member, although fasteners such as nuts and bolts could also be used. The bristles forming wiping pad 24 are short, only a few millimeters long, or less, and are either of natural or artificial origin, forming a dense mat, and are either adhesively attached to or embedded within substrate 22. Of course, it is also contemplated that pad 24 may be directly attached to base 20, depending on compatibility of the materials used. It can also clearly be seen how the bristles along the edge of the pad extend to the side so as to scrub the sidewalls and deep within the corners of the track.

Figure 9:
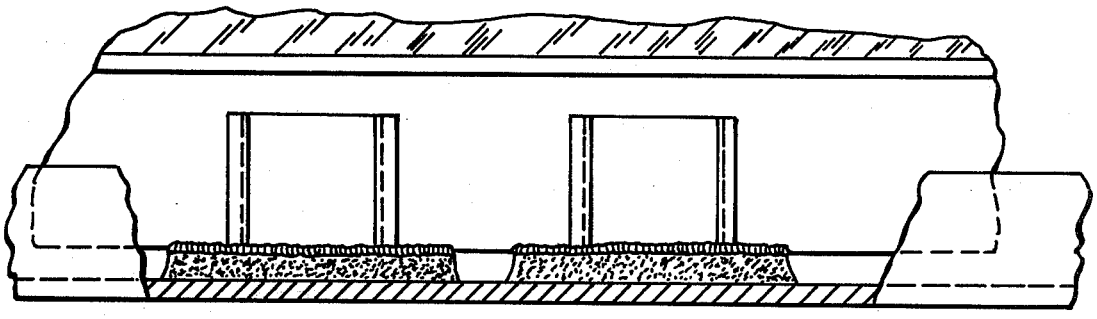
FIG. 9 is a partial side elevational view of a wiper assembly in accordance with the present invention.

FIG. 9, similar to FIG. 3, shows a plurality of wipers spaced along the length of bottom edge 56 of a track.

What is claimed is:

1. A wiper for clearing the track of a sliding door or window assembly comprising, a fluid dispersive pad having a width dimension, and means for coupling said pad to the bottom edge of a sliding door or window assembly so that the width dimension of said pad is in substantially complete contact with the bottom of a groove defined in an elongated track within which said door or window slides.

2. A wiper as recited in claim 1 wherein said coupling means comprises, an elongated base;

attachment means for attaching said base to said door or window, and fastener means for fastening said pad to said base.

3. A wiper as recited in claim 2 wherein said attachment means comprises, an upright flange attached to said base, and a screw type fastener fastening said flange to a vertical edge of said door or window.

4. A wiper as recited in claim 1 wherein said pad extends along substantially the entire length of the bottom edge of said door or window.

5. A wiper as recited in claim 1 wherein said pad has a length substantially shorter than the length of the bottom edge of said door or window.

6. In an installation of the type wherein one or more doors or windows slides along one or more respective tracks, the improvement comprising, a pad of fluid dispersive material connected to the bottom edge of a door or window which slides in a track of the type having a bottom and opposed sidewalls, said pad contacting the full lateral width of the bottom of said track.

7. The installation of claim 6 wherein a plurality of said pads are each connected to the bottom edge of said door or window.

8. A wiper for clearing the track of a sliding door or window assembly comprising, a fluid dispersive pad having a resilient substrate with a surface adapted to be fastened to said base, and a scrubbing material extending from an opposing surface of said substrate for contact with said track, and means for coupling said pad to a sliding member of a sliding door or window assembly so that said pad is in substantially complete contact with a lateral width of an elongated track of such an assembly with which said sliding member is slidably engaged.

9. A wiper as recited in claim 8 wherein said scrubbing material includes a dense mass of bristles.

10. A wiper as recited in claim 8 wherein said means for coupling said pad to said sliding member comprises a bracket means for engagement with a bottom edge portion of said sliding member.

11. A wiper as recited in claim 10 wherein said bracket includes a pair of upright arms attached to said base.

12. A wiper as recited in claim 11 wherein at least a portion of the surfaces of said upright arms that face said door or window are covered with a material having a high coefficient of friction.

13. A wiper as recited in claim 8 wherein said means for coupling said pad to said sliding member comprises, an elongated base, an upright flange attached to said base, and a fastener means for connecting said flange to a vertical edge of said door or window wherein said flange is adapted to receive the fastener means in a cooperative relation therewith.

14. A wiper as recited in claim 8 wherein said means for coupling said pad to said sliding member comprises, a base having a portion supporting said pad attached along the bottom edge of said door or window and has another portion extending beyond a vertical edge of said door or window that terminates with a section that is bent upwardly in relation to the remainder of said base whereby the portion of the pad fastened to said section is adapted to scrub the sidewalls and end of said track.

* * * * *